US006444059B2

(12) United States Patent
Raynaud et al.

(10) Patent No.: US 6,444,059 B2
(45) **Date of Patent: *Sep. 3, 2002**

(54) PRODUCT FOR A WELDED CONSTRUCTION MADE OF ALMGMN ALLOY HAVING IMPROVED MECHANICAL STRENGTH

(75) Inventors: Guy-Michel Raynaud, Issoire; Jean-Luc Hoffmann, Moirans; Laurent Cottignies, Grenoble; Georges Pillet, Saint Cassin, all of (FR)

(73) Assignee: Pechiney Rhenalu, Courbevoie (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/875,113

(22) PCT Filed: Feb. 21, 1996

(86) PCT No.: PCT/FR96/00279

§ 371 (c)(1),
(2), (4) Date: Jul. 25, 1997

(87) PCT Pub. No.: WO96/26299

PCT Pub. Date: Aug. 29, 1996

(30) Foreign Application Priority Data

Feb. 24, 1995 (FR) ..... 95 02387
Oct. 9, 1995 (FR) ..... 95 12065

(51) Int. Cl.[7] ..... C22C 21/06

(52) U.S. Cl. ..... 148/440; 148/439; 420/542

(58) Field of Search ..... 148/439, 440; 420/542, 543, 544, 545, 546

(56) References Cited

PUBLICATIONS

Reiners et al., "Microstructure and Mechanical Properties of Aluminum to Steel Friction Welds", Schweissen und Schneiden 40, 1988, Heft 3, pp. 123–129.*

Registration Record of International Alloy Designations and Chemical Compositions Limits for Wrought Aluminum and wrought Aluminum Alloys, Apr. 1991.*

Sugiyama, "Relation Between Mechanical Properties and Chemical Composition Weldable Structural Aluminum Alloy (5083) Weld", Journal Light Metal and Construction (Jpn) 1978, 16, (2) 60–71, 1988.*

Ltr. of Aug. 30, 1995—The Aluminium Association, Wash., DC, re signatories of the Decla. of Accord DA of the regist. of Alloy AA5385.

Advances in Hot Deformations Textures and Microstructures "Effect of Precipitate Structure on Hot Deformation of Al–Mg–Mn Alloys", Vetrano et al, Metals & Materials Society, 1994, pp. 223–235.

"Development of Superplasticity in 5083 aluminum with Additions of Mn and Zr", Lavender et al, Material Science Forum, vols. 170–172, pp. 279–286, 1994.

"Effect of Grain size and Dendirte . . . in al–Mg–Mn Alloys", Fukui et al, Journal of Light Metal Welding Construction, vol. 5, 1972, pp. 103, 210.

"The Deformation of Commerical Aluminum–Magnesium Alloys", Lloyd, Metallurgical transactions A, vol. 11A, Aug. 1980, pp. 1287–1294.

Composition Affects Tensile Strength of Welded Aluminium–Magnesium Alloy, Cassie, Metal Constructs & British Welding Journal, Jan. 1973, pp. 11–19.

"Effect of Filler Wire . . . of Thick Al–Mg Alloy 5083–0 Welds", Sakaguchi, 11W Doc. No. 1X–962–76, Intl. Institute of Welding, Apr. 1996, pp. 1–27.

"Fracture Characteristics of Thick Aluminum Alloy 5083/5183 Welds", Kuriyama, Doc. 1X–882–74, Intl Institute of Welding, 1974, pp. 1–21.

"Light Alloys Metallurgy of the Light Metals" Polmear, 2nd Edit. 1989.

"Versagen Durch Scherbander . . . Aluminumwerkstoffen", Akeret, Z. Matallkde 92, 1991, pp. 249–258.

"Aluminium Properties and Physical Metallurgy", (Text Book), edited by Hatch, American Society for Metals, 1984.

"Superplastic Behavior of Al–Mg–Cu Alloys", Watanabe et al, Transactions ISIJ, vol. 27, 1987, pp. 730–3.

"Theory Assisted Design . . . Alloy Aluminum", Hornbogen et al, Acta Metall. Meter. vol. 41, No. 1, 1993, pp. 1–16.

"Physical Metallurgy of Recycling . . . Alloys", Hess, Metallurgical Transactions A. vol. 14A, Mar. 1983, pp. 323–327.

ASM Specialty Handbook, Aluminium and Aluminum Alloys, ASM International, Materials Pack, 1994, pp. 675–676.

"Tensile and Toughness Properties . . . 5083 and 6082 Aluminum Alloys", Scott et al, Welding Research Supplement, 1983, pp. 243–252.

(List continued on next page.)

*Primary Examiner*—John Sheehan
(74) *Attorney, Agent, or Firm*—Dennison, Schultz & Dougherty

(57) ABSTRACT

Rolled or extruded products for welded constructions are made of an aluminum-magnesium-manganese type aluminum alloy, consisting essentially of, by weight:

3.0<Mg<5.0
0.5<Mn<1.0
Fe<0.25
Si<0.25
Zn<0.40
Cr<0.25
Cu<0.20
Ti<0.20
Zr<0.20

The product has a volumetric fraction of Mn containing dispersoids grater than 1.2%.

13 Claims, No Drawings

OTHER PUBLICATIONS

"Fracture Toughness . . . Aluminum Alloy Plate", Nelson et al, 1972 Proc. –Nat. Sym. on Fract. Mechs., Phila., Pa. 28–30, 1972, ASTM 1973, pp. 350–376.

"Fracture Mechanics Aspects . . . Vessels for LNG Tankers", Kaufman et al, Journal of Eng. Materials and Tech., 1980, vol. 102, pp. 303–314.

"Fatigue of Materials", Suresh, Cambridge Univ. Press, 1991, ISBN 0 521 36510 4, pp. 119–122.

"Microstructure and Toughness . . . Aluminum Alloys", Staley, Amer. Soc. for Testing & Materials, Montreal CA, 1975, ASTM, Pub. 605, pp. 71–103.

On the Fabrication Aspect of Commercial . . . 5083 Aluminum Alloy Sheets, Yang et al, TMS 1995, Annual Meeting Feb. 1995, Las Vegas, USA, pp. 17–24.

* cited by examiner

PRODUCT FOR A WELDED CONSTRUCTION MADE OF ALMGMN ALLOY HAVING IMPROVED MECHANICAL STRENGTH

FIELD OF THE INVENTION

The invention relates to the sphere of rolled or extruded products such as sheets, profiles, wires or tubes made of AlMgMn-type aluminium alloy containing more than 3% by weight of Mg, intended for welded constructions having a high yield stress, good resistance to fatigue and good toughness for structural applications such as ships, industrial vehicles or welded bicycle frames.

DESCRIPTION OF THE RELATED ART

The optimum dimensioning of welded structures made of aluminium alloy leads to the use of 5,000 series AlMg alloys according to the Aluminium Association nomenclature, in the cold-worked temper (temper H1 according to the standard NF-EN-515) or partially softened temper (temper H2), or stabilized temper (temper H3), while maintaining high resistance to corrosion (temper H116) rather than the annealed temper (temper O). However, the improvement in the mechanical characteristics relative to the temper O does not usually remain after welding, and certifying and monitoring organizations generally recommend that only the characteristics in temper O be taken into consideration for welded structures. The resistance to fatigue and the fissure propagation rate should also be taken into consideration for dimensioning.

In this sphere, research has concentrated mainly on the implementation of the welding operation itself. There have also been attempts to improve the corrosion resistance of the article by appropriate thermomechanical treatments.

Japanese patent application JP 06-212373 proposes the use of an alloy containing 1.0 to 2.0% of Mn, 3.0 to 6.0% of Mg and less than 0.15% of iron to minimize the reduction in the mechanical strength due to welding. However, the use of an alloy having such a high manganese content leads to a reduction in the resistance to fatigue and in the toughness.

SUMMARY OF THE INVENTION

The object of the invention is significantly to improve the mechanical strength and fatigue resistance of welded structures made of AlMgMn alloy, under predetermined welding conditions, without unfavourable consequences for other parameters such as toughness, corrosion resistance and cutting deformation, due to internal stresses.

The invention relates to products for welded constructions made of AlMgMn aluminium alloy composed of (% by weight):

$3.0<Mg<5.0$ $0.5<Mn<1.0$ $Fe<0.25$ $Si<0.25$ $Zn<0.40$ optionally one or more of the elements Cr, Cu, Ti, Zr such that:

$Cr<0.25$ $Cu<0.20$ $Ti<0.20$ $Zr<0.20$ other elements <0.05 each and <0.15 in total, wherein $Mn+2Zn>0.75$.

DETAILED DESCRIPTION OF THE INVENTION

Contrary to earlier research which concentrated on the welding process and the thermomechanical treatments, the inventors have found a particular, range of composition for minor alloying elements, in particular iron, manganese and zinc, leading to an interesting set of properties combining static mechanical characteristics, toughness, resistance to fatigue, resistance to corrosion and cutting deformation, this set of properties being particularly well adapted to the use of these alloys for naval construction, utility vehicles or the welded frames of bicycles.

This set of properties is obtained by combining a low iron content, <0.25%, preferably <0.20%, and even 0.15%, and a manganese and zinc content such that $Mn+2Zn>0.75\%$, preferably >0.8%. The Mn content should be >0.5%, preferably >0.8%, to have adequate mechanical characteristics, but should not exceed 1% if a deterioration in toughness and fatigue resistance are to be avoided. The addition of zinc combined with manganese has been found to have a beneficial effect on the mechanical characteristics of welded sheets and joints. However, it is better not to exceed 0.4% because problems can then be encountered in welding.

The magnesium is preferably kept >4.3%, because it has a favourable effect on the yield stress and fatigue resistance, but beyond 5% the corrosion resistance is less good. The addition of Cu and Cr are also favourable to the yield stress, but Cr is preferably kept <0.15% to maintain good resistance to fatigue.

The mechanical strength of the sheets depends both on the magnesium content in solid solution and on the manganese dispersoids. It has been found that the volumetric fraction of these dispersoids, which is linked to the iron and manganese contents, should preferably be kept above 1.2%. This volumetric fraction is calculated from the average of the surface fractions measured on polished cuts produced in three directions (length, width and thickness) by scanning electron microscopy and image analysis.

The products according to the invention can be rolled or extruded products such as hot- or cold-rolled sheets, wires, profiles or extruded and optionally drawn tubes.

The sheets according to the invention, which are assembled by butt welding by a MIG or TIG process and with a bevel of the order of 45° over about ⅔ of the thickness have, in the welded region, a yield stress $R_{0.2}$ which can be at least 25 MPa higher than that of a conventional alloy having the same magnesium content, that is a gain of about 20%.

The width of the thermally affected region is reduced by about one third relative to a conventional 5083 alloy, and the hardness of the welded joint increases from about 75 Hv to more than 80 Hv. The welded joints also have a tensile strength exceeding the minimum imposed by organizations monitoring unwelded cold-worked crude sheets.

The sheets according to the invention have fatigue resistance, measured by plane bending with a stress ratio wherein R=0.1 on samples taken in the cross-longitudinal direction, higher than:

$10^5$ cycles with a maximum stress >280 MPa $10^6$ cycles with a maximum stress >220 MPa $10^7$ cycles with a maximum stress >200 MPa.

The fissure propagation rate $\Delta K$, measured when R=0.1, is >22 Mpa$\sqrt{m}$ when $da/dN=5\times10^{-4}$ mm/cycle and >26 Mpa $\sqrt{m}$ when $da/dN=10^{-3}$ mm/cycle.

The sheets according to the invention usually have a thickness greater than 1.5 mm. With thicknesses greater than 2.5 mm they can be obtained directly by hot rolling, without the need for subsequent cold rolling and, furthermore, these hot-rolled sheets are less distorted on cutting than cold-rolled sheets.

The products according to the invention have corrosion resistance which is as good as that of normal alloys having the same magnesium content, for example 5083 of common composition, widely used in naval construction.

EXAMPLE

Thirteen samples of sheets were prepared by conventional semicontinuous casting in the form of plates, were heated for 20 h at a temperature >500° C. and were then hot-rolled to the final thickness of 6 mm. The reference 0 corresponds to a conventional 5083 composition and reference 1 to a composition slightly outside the invention. The 11 others (references 2 to 12) have a composition according to the invention.

The compositions were as follows (% by weight):

| Ref | Mg | Cu | Mn | Fe | Cr | Zn | Ti | Zr |
|---|---|---|---|---|---|---|---|---|
| 0 | 4.40 | <0.01 | 0.50 | 0.27 | 0.09 | 0.01 | 0.01 | |
| 1 | 4.68 | <0.01 | 0.72 | 0.12 | 0.05 | <0.01 | 0.01 | |
| 2 | 4.56 | <0.01 | 0.83 | 0.12 | 0.13 | 0.01 | 0.01 | |
| 3 | 4.60 | <0.01 | 0.85 | 0.17 | 0.10 | 0.16 | 0.01 | |
| 4 | 4.62 | <0.01 | 0.96 | 0.10 | 0.05 | 0.02 | 0.01 | |
| 5 | 4.80 | 0.09 | 0.80 | 0.11 | 0.03 | 0.02 | 0.01 | |
| 6 | 4.72 | <0.01 | 0.87 | 0.13 | 0.03 | 0.02 | 0.01 | 0.11 |
| 7 | 4.88 | 0.05 | 0.78 | 0.16 | 0.02 | 0.01 | 0.09 | |
| 8 | 4.92 | 0.06 | 0.94 | 0.08 | 0.02 | 0.19 | 0.01 | |
| 9 | 4.69 | <0.01 | 0.72 | 0.07 | 0.02 | 0.10 | 0.01 | |
| 10 | 4.71 | <0.01 | 0.82 | 0.06 | 0.02 | <0.01 | 0.01 | |
| 11 | 4.73 | <0.01 | 0.95 | 0.17 | 0.03 | <0.01 | 0.01 | |
| 12 | 4.70 | <0.01 | 0.92 | 0.22 | 0.03 | 0.01 | | |

The samples all have, after rolling, a yield stress $R_{0.2}$>220 Mpa in the L direction.

The mechanical strength of the joints welded from these sheets was measured under the following conditions: continuous automatic MIG butt welding with a symmetrical bevel having an inclination of 45° to the vertical over a thickness of 4 mm and filler wire of 5183 alloy.

The mechanical characteristics (tensile strength $R_m$, yield stress $R_{0.2}$) were obtained by pulling over samples standardized by the Norwegian monitoring organization DNV for naval construction having a length of 140 mm and a width of 35 mm, the weld bead with a width of 15 mm being in the centre and the length of the narrow portion of the sample being 27 mm, that is the sum of the width of the bead and twice the thickness (15+22 mm).

The volumetric fractions of manganese dispersoids was also measured.

The results are as follows (in MPa for resistances and % for fractions):

| Ref. | $R_m$ | $R_{0.2}$ | Fractions |
|---|---|---|---|
| 0 | 285 | 131 | 0.62 |
| 1 | 292 | 144 | 1.2 |
| 2 | 302 | 150 | 1.4 |
| 3 | 300 | 146 | 1.6 |
| 4 | 310 | 158 | 1.7 |
| 5 | 309 | 149 | 1.4 |
| 6 | 305 | 155 | 1.5 |

-continued

| Ref. | $R_m$ | $R_{0.2}$ | Fractions |
|---|---|---|---|
| 7 | 315 | 166 | 1.3 |
| 8 | 318 | 164 | 1.9 |
| 9 | 310 | 153 | 1.5 |
| 10 | 312 | 150 | 1.5 |
| 11 | 315 | 153 | 1.6 |
| 12 | 315 | 151 | 1.5 |

It is found that the yield stress of samples welded according to the invention increases by between 15 and 35 MPa relative to the reference sample.

The resistance to fatigue of unwelded sheets subjected to plane bending wherein R=0.1 was also measured for references 0 to 5, while determining the maximum stress (in MPa) corresponding to $10^6$ and $10^7$ cycles respectively, as well as the fissure propagation rate ΔK measured when $da/dn=5\times10^{-4}$ mm/cycle (in $Mpa\sqrt{m}$).

The results were as follows:

| Ref. | $10^6$ cycles | $10^7$ cycles | ΔK |
|---|---|---|---|
| 0 | 220 | 200 | 22 |
| 1 | 235 | 205 | 22 |
| 2 | 230 | 200 | 23 |
| 3 | 225 | 200 | 23 |
| 4 | 230 | 205 | 22 |
| 5 | 225 | 200 | 22 |

It is found that, despite the increase in the mechanical strength, the sheets according to the invention have resistance to fatigue which is at least as good as that of conventional 5083 sheets.

What is claimed is:

1. A welded construction comprising first and second sections made of AlMgMn aluminum alloy welded together to form a joint having a hardness >80 Hv, said alloy consisting essentially of (% by weight):

4.3<Mg<5.0

0.5<Mn<1.0

Fe<0.20

Si<0.25

Zn<0.40

Cr<0.25

Cu<0.20

Ti<0.20

Zr<0.20 wherein Mn+2Zn>0.75, each of said sections having been formed by casting, homogenizing, hot rolling and optionally cold rolling, wherein the welded joint, when prepared by continuous automatic MIG butt welding with a symmetrical bevel having an inclination of 45° to vertical over a thickness of 4 mm and with filler wire of 5183 alloy, determined by a tensile test on standardized DNV test pieces having a length of 140 mm and a width of 35 mm, a center weld bead with a width of 15 mm, and a length of a narrow portion which is the sum of bead width and twice section thickness, has a yield stress $R_m$ greater than 300 MPa.

2. Welded construction according to claim 1, wherein Mg>4.3%.

3. Welded construction according to claim 1, wherein Mn>0.8%.

4. Welded construction according to claim 1, wherein Fe<0.15%.

5. Welded construction according to claim 1, wherein said first and second sections are in the form of sheets of thickness >2.5 mm which are only hot rolled.

6. Welded construction according to claim 1, wherein the first and second sections have fatigue resistance, measured by plane bending wherein R=0.1 in the cross-longitudinal direction, higher than:

$10^5$ cycles with a maximum stress >280 MPa;

$10^6$ cycles with a maximum stress >220 MPa; and $10^7$ cycles with a maximum stress >200 MPa.

7. Welded construction according to claim 1, wherein the first and second sections have a fissure propagation rate ΔK, measured when R=0.1, higher than:

22 Mpa√m when $da/dn=5\times10^{-4}$ mm/cycle; and

26 Mpa√m when $da/dn=10^{-3}$ mm/cycle.

8. Welded construction according to claim 1, wherein said alloy has a fraction of Mn-containing dispersoids greater than 1.2%.

9. Welded construction according to claim 1, which forms part of a naval construction.

10. Welded construction according to claim 1, which forms part of an industrial vehicle.

11. Welded construction according to claim 1, wherein the first and second sections are welded tubes which form part of a bicycle.

12. Welded construction according to claim 1, wherein Mn+2Zn>0.80.

13. Product according to claim 1, wherein Zn is at least 0.01.

* * * * *